United States Patent [19]

Drake et al.

[11] 4,382,026

[45] May 3, 1983

[54] PROCESS FOR ENCAPSULATING RADIOACTIVE ORGANIC LIQUIDS IN A RESIN

[75] Inventors: Stevens S. Drake; Harold E. Filter, both of Midland, Mich.

[73] Assignee: The Dow Chemical Company, Midland, Mich.

[21] Appl. No.: 230,139

[22] Filed: Jan. 30, 1981

Related U.S. Application Data

[63] Continuation of Ser. No. 962,539, Nov. 20, 1978, abandoned.

[51] Int. Cl.[3] ..... G21F 9/12; G21F 9/16

[52] U.S. Cl. ..... 252/628; 252/634; 252/635; 264/0.5

[58] Field of Search ..... 252/628, 634, 635; 264/0.5

[56] References Cited

U.S. PATENT DOCUMENTS

| | | | |
|---|---|---|---|
| 3,520,806 | 7/1970 | Haigh | 210/692 |
| 4,009,116 | 2/1977 | Bähr et al. | 252/628 |
| 4,077,901 | 3/1978 | Arnold et al. | 252/628 |
| 4,131,563 | 12/1978 | Bähr et al. | 252/628 |

*Primary Examiner*—Leland A. Sebastian

[57] ABSTRACT

Radioactive organic liquids are converted to a form suitable for burial by the process wherein the liquid is contacted with insoluble, swellable polymer particles to form swollen gelled particles which are dispersed in an unsaturated polyester, vinyl ester resin or mixture thereof which is then cured to a solid state with the gelled particles encased therein.

7 Claims, No Drawings

PROCESS FOR ENCAPSULATING RADIOACTIVE ORGANIC LIQUIDS IN A RESIN

This is a continuation of application Ser. No. 962,539, filed Nov. 20, 1978, now abandoned.

BACKGROUND OF THE INVENTION

Among the many problems associated with the utilization of radioactive materials is the disposal of the waste material. The prior techniques for such disposal included the encapsulation of the waste in a solid and the burial of that solid in designated sites. Both concrete and urea/formaldehyde resins have been so used. More recently it has been proposed that such wastes in solid form, aqueous solutions or slurries can be dispersed in unsaturated polyesters or vinyl ester resins and converted to a solid with droplets of the liquid dispersed therein.

Each of the prior techniques are useful with the aqueous wastes resulting from nuclear power plant operation. However, those techniques have severe shortcomings when attempts are made to use them with the radioactive organic solvent wastes from nuclear power plants, such as oils and also those wastes emanating from chemical and medical laboratories. Such wastes are usually water insoluble but may be soluble, partially soluble or insoluble in the resin system or may be a solvent for the resin system or parts thereof.

It is possible to disperse certain organic liquids that are water insoluble but partially soluble in the resin system by those prior techniques. However, above some relatively low concentration of such organic wastes, the organic material will phase separate. At that point the organic material acts like a plasticizer and even after resin cure, can migrate through the system. Since long term storage is the objective with radioactive wastes, such migration could defeat the purpose of encapsulation by having the waste at the surface.

Such wastes present a serious disposal problem of prime ecological concern.

SUMMARY OF THE INVENTION

Radioactive water-insoluble organic liquid wastes are contacted with polymer particles which are swellable by that waste and the swollen, gelled particles are dispersed in an unsaturated polyester, a vinyl ester resin or a mixture thereof which is then cured to a solid. The present method minimizes any possible migration of the organic waste through the system.

DESCRIPTION OF THE INVENTION

Those radioactive wastes for which the present process is useful include water-insoluble organic liquids and mixtures of such liquids with water. Included within the scope of such organic liquids are the hydrocarbons, such as benzene, toluene, xylene, the naphthas, cyclohexane, octane, dodecane and the halogenated derivatives of such compounds, including the chlorinated compounds such as 1,1,1-trichloroethane, tetrachloroethane, chlorinated aromatic materials and others. Also included within the scope are the oils, such as the light or heavy oils, lubricating oil, diesel oil and the like as well as gasolines and kerosenes.

Frequently the waste material will be a mixture of water and the water-insoluble organic liquid. The present process finds equal utility with such mixtures.

The polymer particles useful to contain the radioactive liquid organic waste are of a cross-linked organic liquid-swellable, organic liquid-insoluble polymer. By organic liquid-swellable, organic liquid-insoluble polymer is meant those polymers having the property of being substantially insoluble in, but capable of being swollen, that is, imbibing, one or more of the water-insoluble organic liquids described above. In other words, these polymers are swellable by any organic liquid which is a solvent for the polymers linear analog.

Preferably, cross-linked polymers of alkylstyrenes, and advantageously of tertiary alkylstyrenes, are utilized as the imbibing agent in the process of this invention. Those alkylstyrenes which can be used to prepare these polymers have alkyl groups containing from 4 to 20, preferably from 4 to 12 carbon atoms, such as tertiary alkylstyrenes including for example, p-tert-butylstyrene, p-tert-amylstyrene, p-tert-hexylstyrene, p-dodecylstyrene; n-alkylstyrenes including, for example, n-butylstyrene, n-hexylstyrene, n-decylstyrene; and sec-alkylstyrenes including, for example, sec-butylstyrene, sec-octylstyrene, sec-dodecylstyrene; and isoalkylstyrenes including, for example, isobutylstyrene, isooctylstyrene and isododecylstyrene.

Also useful in the practice of the invention are cross-linked copolymers of such alkylstyrenes as heretofore described and an alkyl ester derived from a $C_1$ to $C_{18}$ alcohol and acrylic or methacrylic acid or mixture thereof. To insure buoyancy or water as well as the capability of imbibing or being swelled by a wide range of organic liquids, it is preferred that the copolymers, such as those of p-tert-butylstyrene and methylmethacrylate, contain at least 50 mole percent of the alkylstyrene.

However, any cross-linked polymer whose linear analogue is organic liquid-soluble can be used in the process of the invention, e.g., cross-linked vinyl-addition type polymer, and copolymers of essentially lipophilic monomer compositions including: alkenyl aromatic compounds such as vinyl naphthalenes, styrene, and substituted styrenes for example, alpha-methylstyrenes, ring-substituted alpha-methylstyrenes, alkylstyrenes, halostyrenes, arylstyrenes, and alkarylstyrenes; methacrylic esters, acrylic esters, fumarate esters and half esters, maleate esters and half esters, itaconate esters and half esters, vinyl biphenyls, vinyl esters of aliphatic carboxylic acid esters, alkyl vinyl ethers, alkyl vinyl ketones, alpha-olefins, isoolefins, butadiene, isoprene, dimethylbutadiene, and the like.

It is important that the polymers used as imbibing agents in the process of the invention contain a slight amount of cross-linking agent, preferably in the range of from about 0.01 to 2 percent by weight. The most efficient imbibition of organic liquid contaminants, especially from dispersions, occurs when the level of cross-linking agent is less than about 1 percent since this permits the polymers to swell easily and imbibe a substantial volume of the organic liquid. When organic liquid contaminated fluids are percolated through a packed column or bed, up to 2 percent cross-linking agent is satisfactory for the reason that a lower volume of organic liquid material imbibed by the polymer can be tolerated in this type of operation.

Cross-linking agents which can be used in preparing the imbibing polymers suitable for use in the present invention include polyethylenically unsaturated compounds such as divinylbenzene, diethylene glycol dimethacrylate, diisopropenylbenzene, diisopropenyldiphenyl, diallylmaleate, diallylphthalate, allylacrylates, allylmethacrylates, allylfumarates, allylitaconates, alkyd resin types, butadiene or isoprene polymers, cyclooctadiene, methylene norbornylenes, divinyl phthalates, vinyl isopropenylbenzene, divinyl biphenyl, as well as any other di- or poly-functional compounds known to be of use as a cross-linking agent in polymeric vinyl-addition compositions. Normally, the polymer containing the cross-linking agent swells with the imbibed organic liquids. If there is too much cross-linking agent, the imbibition takes an unreasonably long time or the polymer is unable to imbibe a sufficient quantity of the organic liquid, thus reducing the effectiveness of the polymer as an imbiber. If the imbibitional polymer contains no cross-linking agent or too little cross-linking agent, then it will dissolve in the organic liquid resulting, for example, in a nondiscrete, nonparticulate mass of polymer.

Such polymer particles are sometimes mixed with oleophilic materials of great surface area to function as an inert wick and aid in the uptake of the organic liquid by the particles. Such oleophilic materials are exemplified by ground up resinous foams as well as such mundane substances as ground up truck tires and other similar materials. The presence of a wicking agent shortens the time for the particles to be swollen by uptake of the organic liquid. Without such an agent the uptake may take a prohibitively long time.

The various cross-linked polymers will also have different imbibition capacity for the organic liquid depending on the characteristics of the organic liquid. That capacity can be easily determined by simple preliminary experiments.

Thus, both the amount of swelling of the imbibing polymer particles and the amount of polymer to be used to imbibe organic liquids in the practice of this invention depend upon the amount and type of liquid to be imbibed, as well as the particular polymer employed and the extent to which the polymer is cross-linked. Normally less than one, and usually less than 0.1, part by weight of imbibing polymer per part of organic liquid is used in the practice of the inventive concept. If too high a ratio of beads to organic liquid is employed the beads may imbibe a part of any reactive diluent that is used and thereby change the character of the system particularly as regards viscosity.

Various methods of carrying out the imbibition of the organic liquid by the polymer particles will be apparent. In one method the particles are introduced into the organic liquid with relatively gentle agitation. The agitation should not be of sufficient magnitude to cause significant shearing of the polymer particles to sizes of less than about 0.05 millimeter diameter. Particles of such small size are generally more difficult to handle in the subsequent materials handling operations of the invention. Generally, particles having a size range of from about 0.1 to about 1 millimeter diameter are preferred.

In another embodiment a column or bed is packed with the imbibing polymer particles and the organic liquid passed therethrough.

Similar techniques can be employed when the waste is a mixture of water and radioactive organic liquid. The polymer particles may be mixed with a dispersion of the organic liquid and water. The organic liquid may be allowed to separate and in most cases to rise to the surface of the water. The beads can then be deposited in the organnic liquid.

Any of the embodiments is operable at any temperature at which the radioactive waste is a liquid. Usually the imbibition will be carried out at ambient temperatures and normal pressures to permit the use of less complicated equipment and to minimize the risk of any personnel exposure to radioactivity.

Vinyl ester resins are described in U.S. Pat. No. 3,367,992 wherein dicarboxylic acid half esters of hydroxyalkyl acrylates or methacrylates are reacted with polyepoxide resins. Bowen in U.S. Pat. Nos. 3,066,112 and 3,179,623 describes the preparation of vinyl ester resins from monocarboxylic acids such as acrylic and methacrylic acid. Bowen also describes alternate methods of preparation wherein a glycidyl methacrylate or acrylate is reacted with the sodium salt of a dihydric phenol such as bisphenol A. Vinyl ester resins based on epoxy novolac resins are described in U.S. Pat. No. 3,301,743 to Fekete et al. Fekete et al. also describe in U.S. Pat. No. 3,256,226 vinyl ester resins wherein the molecular weight of the polyepoxide is increased by reacting a dicarboxylic acid with the polyepoxide resin as well as acrylic acid, etc. Other difunctional compounds containing a group which is reactive with an epoxide group, such as an amine, mercaptan and the like may be utilized in place of the dicarboxylic acid. All of the above-described resins, which contain the characteristic linkages

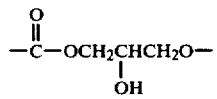

and terminal, polymerizable vinylidene groups, are classified as vinyl ester resins, and are incorporated herein by reference.

Briefly, any of the known polyepoxides may be employed in the preparation of the vinyl ester resins of this invention. Useful polyepoxides are glycidyl polyethers of both polyhydric alcohols and polyhydric phenols, epoxy novolacs, epoxidized fatty acids or drying oil acids, epoxidized diolefins, epoxidized di-unsaturated acid esters as well as epoxidized unsaturated polyesters, so long as they contain more than one oxirane group per molecule.

Preferred polyepoxides are glycidyl polyethers of polyhydric alcohols or polyhydric phenols having weights per epoxide group of about 150 to 2000. These polyepoxides are usually made by reacting at least about two moles of an epihalohydrin or glycerol dihalohydrin with one mole of the polyhydric alcohol or polyhydric phenol, and a sufficient amount of a caustic alkali to combine with the halogen of the halohydrin. The products are characterized by the presence of more than one epoxide group per molecule, i.e., a 1,2-epoxy equivalency greater than one.

Unsaturated monocarboxylic acids include acrylic acid, methacrylic acid, halogenated acrylic or methacrylic acid, cinnamic acid and the like and mixtures thereof. Also included within the term "unsaturated carboxylic acids" are the hydroxyalkyl acrylate or methacrylate half esters of dicarboxyl acids as described in U.S. Pat. No. 3,367,992 wherein the hydroxyalkyl group preferably has from 2 to 6 carbon atoms.

Preferably, the thermosettable resin phase comprises the vinyl ester or polyester resin and a copolymerizable monomer. Suitable monomers must be essentially water-insoluble to maintain the monomer in the resin phase in the emulsion, although complete water-insolubility is not required and a small amount of monomer dissolved in the emulsified water does no harm.

Suitable monomers include vinyl aromatic compounds such as styrene, vinyltoluene, divinylbenzene and the like. Other useful monomers include the esters of saturated alcohols such as methyl, ethyl, isopropyl, octyl, etc., with acrylic acid or methacrylic acid; hydroxyethyl or hydroxypropyl acrylate or methacrylate, vinyl acetate, diallyl maleate, dimethallyl fumarate; mixtures of the same and all other monomers which are capable of copolymerizing with the vinyl ester resin and are essentially water insoluble.

Another embodiment of this invention utilizes a modified vinyl ester resin wherein about 0.1 to 0.6 mole of a dicarboxylic acid anhydride per equivalent of hydroxyl is reacted with the vinyl ester resin. The shelf stability of the water-in-resin emulsion prepared from said modified vinyl ester resin is somewhat less, comparatively, than that found with the unmodified vinyl ester resins, yet the stability is significantly improved over the art. Both saturated and unsaturated acid anhydrides are useful in said modification.

Suitable dicarboxylic acid anhydrides containing ethylenic unsaturation include maleic anhydride, the citraconic anhydrire, itaconic anhydride and the like and mixtures thereof. Saturated dicarboxylic acid anhydrides include phthalic anhydride, anhydrides of aliphatic unsaturated dicarboxylic acid and the like. The modified vinyl ester resin is utilized in this invention in the same manner as already described for the unmodified vinyl ester resin.

A wide variety of unsaturated polyesters which are readily available or can be prepared by methods well known to the art may also be utilized in the method. Such polyesters result from the condensation of polybasic carboxylic acids and compounds having several hydroxyl groups. Generally, in the preparation of suitable polyesters, an ethylenically unsaturated dicarboxylic acid such as maleic acid, fumaric acid, itaconic acid or the like is esterified with an alkylene glycol or polyalkylene glycol having a molecular weight of up to 2000 or thereabouts. Frequently, dicarboxylic acids free of ethylenic unsaturation such as phthalic acid, isophthalic acid, adipic acid, succinic acid and the like may be employed within a molar range of 0.25 to as much as 15 moles per mole of the unsaturated dicarboxylic acid. It will be understood that the appropriate acid anhydrides when they exist may be used and usually are preferred when available.

The glycol or polyhydric alcohol component of the polyester is usually stoichiometric or in slight excess with respect to the sum of the acids. The excess of polyhydric alcohol seldom will exceed 20 to 25 percent and usually is about 10 to 15 percent.

These unsaturated polyesters may be generally prepared by heating a mixture of the polyhydric alcohol with the dicarboxylic acid or anhydride in the proper molar proportions at elevated temperatures, usually at about 150° to 225° C. for a period of time ranging from about 1 to 5 hours.

Polymerization inhibitors such as t-butyl catechol may be advantageously added. It is also possible to prepare unsaturated polyesters directly from the appropriate oxide rather than the glycol, e.g., propylene oxide may be used in place of propylene glycol. Generally, the condensation (polymerization) reaction is continued until the acid content drops to about 2 to 12 percent (-COOH) and preferably from 4 to 8 percent.

Yet, another embodiment of this invention utilizes a vinyl ester/unsaturated polyester resin composition. The composition may be prepared either by physically mixing the two resins in the desired weight proportions or by preparing said vinyl ester resin in the presence of said unsaturated polyester.

While the concept of the invention is operable with wastes that are solely organic, it is preferable that a significant amount of water be present. The water in the dispersion helps to control any exotherm generated during cure. That is particularly important when large masses of curable resin are used and exotherm control by external means becomes difficult. Also the water helps to provide a uniform dispersion and aids in the cured system passing various requirements and regulations such as the Department of Transportation fire test. In addition the water aids in viscosity build to help prevent separation of the waste before gellation.

The water may be present in the waste, can be added to the waste prior to dispersion or can be added to the resin phase to form an emulsion to which the waste in the swollen beads is then added. When the water is added to the waste, it can be mixed with the waste before imbibition or the waste can be imbibed and water then added to form an aqueous slurry.

The proportions of swollen particles alone or with water to the resin phase may be varied within wide limits of between about 0.1 to 3 parts of swollen beads plus any water per part of resin. Preferably, the waste-in-resin dispersions are prepared to contain from about 1 to 1.5 parts of waste plus any water per part of resin.

In the practice of the method of this invention, dispersions of the waste material in the vinyl ester or unsaturated polyester resin may be prepared in a variety of ways. Generally, a free radical yielding catalyst is blended with the resin phase and the radioactive waste imbibed in the beads then dispersed in that resin under conditions to form a uniform waste-in-resin dispersion. While the shear conditions may be widely varied, generally when free water is also present with the waste, sufficient shear should be applied to produce a uniform emulsion of small droplet size.

The dispersions should have sufficient storage stability to last at least through the initial gelation of the resin. The dispersions made with vinyl ester resins, particularly those within the previously described monomer proportions, generally exhibit adequate stability without added emulsifier. Dispersions of swollen particles in water that are to be dispersed in unsaturated polyesters frequently will require added emulsifiers. Such emulsifiers are known in the art and judicious selection to obtain a closed cell system can be made with simple routine experiments. In many instances, especially with carboxyl terminated polyesters, the sodium carboxylate salt will permit emulsification of the waste without added emulsifier.

Catalysts that may be used for the curing or polymerization are preferably the peroxide and hydroperoxide catalysts such as benzoyl peroxide, lauroyl peroxide, cumene hydroperoxide, t-butyl hydroperoxide, methyl ethyl ketone peroxide, t-butyl perbenzoate, potassium persulfate and the like. The amount of the catalyst added will vary but preferably will be at least 0.1 percent by weight of the resin phase.

Preferably, the cure of the dispersion can be initiated at room temperature by the addition of known accelerating agents or promoters, such as lead or cobalt naphthenate, N,N-dimethyl aniline, N,N-dimethyl-p-toluidine, vanadium neodecanoate and the like usually in concentrations ranging from about 0.01 to 5 weight percent. Alternatively the catalyst can be added to the resin before dispersing the waste with the promoter added later after formation of the dispersions. The promoted dispersion can be readily cured to at least a gel state in a short period of time as for example in about 3 to 30 minutes, and to a solid state in 30 minutes to one or two hours, depending on the temperature, the catalyst level and the promoter level. Cure of the dispersion can also be initiated by heating to a temperature of below 100° C. or the boiling point of the organic liquid, whichever is lower. The common practice of post curing thermoset articles at elevated temperatures for varying periods of time may be utilized with this invention.

The conditions of selection of catalyst, catalyst concentration and promoter selection and concentration must be such that the temperature of the exotherm does not exceed the limits stated above at least until the resin has cured to the extent where it has the strength to withstand the increased vapor pressure if the temperature should rise above those limits. If the temperature exceeds 100° C. prior to that state of cure, the water in the liquid waste will boil which may cause waste material to be released or the organic liquid may be released from the swollen particles.

The solidification may be carried out in any suitable vessel such as a 55 gallon drum. Larger or smaller vessels may be used depending on the amount of waste to be disposed of, on the equipment available and on the limitations of handling and transportation stock. As the size of the vessel is increased the control of the exotherm becomes more difficult to maintain within the aforementioned limits. In such cases, it may be desirable to adjust the amount of water and the catalyst concentration and promoter for that control.

The method of the invention is illustrated in the following examples wherein all parts and percentages are by weight unless otherwise indicated.

EXAMPLE 1

A radioactive waste containing about 0.04 microcurie per milliliter of Carbon 14 and tritium in toluene mixed with water was solidified by the following procedure. The toluene was 10 percent and the water 90 percent of the liquid.

To 75 milliliters of a well shaken sample was added 0.38 gram of Imbiber Bead Packet mix. In a few minutes phase separation occurs with the beads rising to the surface. The aqueous phase is decanted and emulsified in 50 grams of a vinyl ester resin containing 1.5 grams Cadox 40E. The vinyl ester resin employed was the polymethacrylic acid ester of a polyepoxide composed of 0.25 equivalent of the diglycidyl ether of bisphenol A (EEW=188) and 0.75 equivalent of an epoxy novolac (EEW=180), the resin diluted with 36 percent styrene.

The swollen beads are added to the water in resin emulsion along with 0.13 milliliter dimethyl toluidine.

The composition gelled in 5.8 minutes and was hard overnight.

Samples were made from the uncured dispersion in a nylon mold 2 inches (5 cm) length by 0.5 inch (12.27 cm) diameter. The loss in radioactivity in 24 hours by water extraction was 2.2 percent Carbon 14 and 1.5 percent tritium.

EXAMPLE 2

The same radioactive waste used in Example 1 was solidified according to that procedure using a polyester resin (Selectron SR 3703) and 2.5 parts per hundred parts resin (phr) of Cadox 40E and 0.2 phr dimethyl toluidine.

Gel time was 6.8 minutes and the sample was hard in 15 to 30 minutes.

What is claimed is:

1. A process for encapsulating low level radioactive liquid water-insoluble organic wastes into a solid form suitable for burial which comprises contacting one part by weight of said waste with less than one part by weight of a particulate, cross-linked, organic liquid-swellable, organic liquid-insoluble polymer to provide discrete, non-coalescent, gelled particles of said polymer and said waste; dispersing 0.1 to 3 parts of said gelled particles essentially uniformly in one part of a curable liquid resin selected from the group consisting of unsaturated polyesters, vinyl ester resins or mixtures thereof and curing said liquid resin to a solid with said gelled particles encased therein.

2. The process of claim 1 wherein the insoluble polymer is a cross-linked copolymer of tertiary butylstyrene and styrene.

3. The process of claim 2 wherein the copolymer is cross-linked with divinylbenzene.

4. The process of claim 1 wherein the liquid organic waste is a hydrocarbon.

5. The process of claim 1 wherein the liquid organic waste is an aqueous dispersion of a radioactive water-insoluble liquid material.

6. The process of claim 5 wherein said organic liquid-insoluble polymer is added to said aqueous dispersion and the dispersion of water and dispersed gelled particles encapsulated in said curable liquid resin.

7. The process of claim 5 wherein said organic liquid-insoluble polymer is added to said aqueous dispersion, the phases permitted to separate, the water stirred into said liquid curable resin to form a water-in-resin emulsion and directly thereafter mixing the gelled particles into said emulsion.

* * * * *